US006027113A

United States Patent [19]

Reljic

[11] Patent Number: 6,027,113

[45] Date of Patent: Feb. 22, 2000

[54] MULTIPLE DOCUMENT DETECTION SYSTEM

[75] Inventor: Bosko Reljic, Plano, Tex.

[73] Assignee: Banctec, Inc., Dallas, Tex.

[21] Appl. No.: 09/182,144

[22] Filed: Oct. 29, 1998

[51] Int. Cl.[7] ..... B65H 7/12

[52] U.S. Cl. ..... 271/260

[58] Field of Search ..... 271/260, 262, 271/265.04, 265.01

[56] References Cited

U.S. PATENT DOCUMENTS

| | | | |
|---|---|---|---|
| 3,504,911 | 4/1970 | Silverberg | 271/260 |
| 3,589,714 | 6/1971 | Staples et al. | 271/56 |
| 3,773,321 | 11/1973 | Burroughs | 271/260 |
| 4,360,108 | 11/1982 | Logothetis | 209/598 |
| 4,608,856 | 9/1986 | Daly, Jr. | 73/37.7 |
| 5,419,546 | 5/1995 | Chen et al. | 271/260 |
| 5,437,375 | 8/1995 | Chen et al. | 209/591 |
| 5,439,506 | 8/1995 | Chen et al. | 95/19 |
| 5,509,648 | 4/1996 | Chen et al. | 271/260 |
| 5,671,919 | 9/1997 | Chen et al. | 271/260 |

*Primary Examiner*—David H. Bollinger
*Attorney, Agent, or Firm*—Locke Liddell & Sapp LLP

[57] ABSTRACT

A multi-item detector for use with a document feeder for feeding documents along a document path includes first and second vacuum heads having juxtaposed faces and being spaced apart on opposite sides along the document path. Each head is adapted to be connected to a vacuum source. The faces of the vacuum heads include a plurality of apertures through which a vacuum is applied for drawing documents into contact with either the first or second vacuum head. A first vacuum sensor is coupled to the first vacuum head. A second vacuum sensor is coupled to the second vacuum head. Each of the sensors have an on-state and an off-state for sensing an increase in vacuum level when a document contacts one of the vacuum heads in order to place the sensor in the on-state. When multiple documents are present in the document path, both sensors are in the on-state.

3 Claims, 2 Drawing Sheets

MULTIPLE DOCUMENT DETECTION SYSTEM

TECHNICAL FIELD OF THE INVENTION

The present invention relates to document detection systems, and more particularly to a vacuum system for detecting the passage of more than one document at a time along a document travel path.

BACKGROUND OF THE INVENTION

High-speed document processing systems, such as those utilized for sorting of bank checks and financial documents are capable of moving and processing large volumes of documents at high speeds, while performing multiple and interrelated operations upon each document as documents travel through feeders and document processors. Such operations may include, for example, printing upon documents, image capturing, and other processes and document manipulations. While processing large volumes of documents, it is important that each individual document be transported and processed singly, and that documents remain in the order and sequence in which they are processed. Should two or more documents be accidentally fed and processed together, subsequent processing time and manual effort and time are required to detect such errors. Therefore, measures have been implemented to insure that document feeding and separating measures always feed documents one at a time through document processing systems.

While document feeders have been developed to minimize the feeding of more than one document at a time, a problem arises when the unavoidable circumstance occurs when more than one document is fed at a time. A need has thus arisen for a system to detect multiple feeding of documents so that appropriate operations may be performed by the system, either to prevent the multiple fed documents from reaching a document handling station, or to allow the document handling station to reject the multiple fed documents.

SUMMARY OF THE INVENTION

In accordance with the present invention, a multi-item detector for use with a document feeder for feeding documents along a document path is provided. The detector includes first and second vacuum heads having juxtaposed faces and being spaced apart on opposite sides along the document path. Each head is adapted to be connected to a vacuum source. The faces of the vacuum heads include a plurality of apertures through which a vacuum is applied for drawing documents into contact with either the first or second vacuum head. A first vacuum sensor is coupled to the first vacuum head. A second vacuum sensor is coupled to the second vacuum head. Each of the sensors have an on-state and an off-state for sensing an increase in vacuum level when a document contacts one of the vacuum heads in order to place the sensor in the on-state. When multiple documents are present in the document path, both sensors are in the on-state.

BRIEF DESCRIPTION OF THE DRAWINGS

For a more complete understanding of the present invention and for further advantages thereof, reference is now made to the following Description of the Preferred Embodiments taken in conjunction with the accompanying Drawings.

DESCRIPTION OF THE PREFERRED EMBODIMENT

Figure 1:
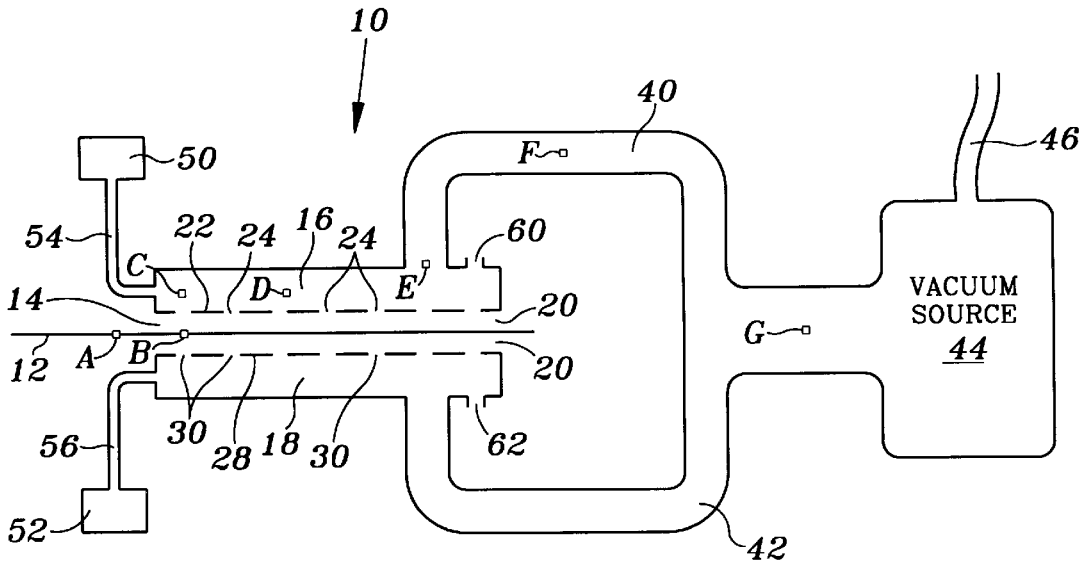
FIG. 1 is a schematic block diagram of the present detection system.

Referring to FIG. 1, the present multiple document detection system is illustrated and is generally identified by the numeral 10. System 10 is utilized for detecting multiple documents 12 present along a document path which may include a path from a document feeder (not shown) to a document sorter (not shown). Documents 12 pass along a document path 14 between a first vacuum head 16 and a second vacuum head 18. Vacuum heads 16 and 18 are spaced apart and are disposed on opposite sides of document path 14. Documents 12 pass through a gap 20 disposed between vacuum heads 16 and 18.

Vacuum head 16 includes a face 22 having a plurality of apertures 24 through which vacuum is applied. Vacuum head 18 includes a face 28 having a plurality of apertures 30 through which vacuum is applied. Application of vacuum through apertures 24 and 30 causes documents 12 to be drawn into contact with either face 22 of vacuum head 16 or face 28 of vacuum head 18. When multiple documents are present within gap 20, each document will be drawn to a respective vacuum head 16 or 18.

Vacuum is applied to heads 16 and 18 via tubing 40 and 42, respectively which interconnect heads 16 and 18 to a vacuum source 44. Vacuum source 44 includes an exhaust aperture 46. Vacuum source 44 may comprise, for example, a blower manufactured and sold by Ametek, Inc. of Kent, Ohio.

Figure 2:
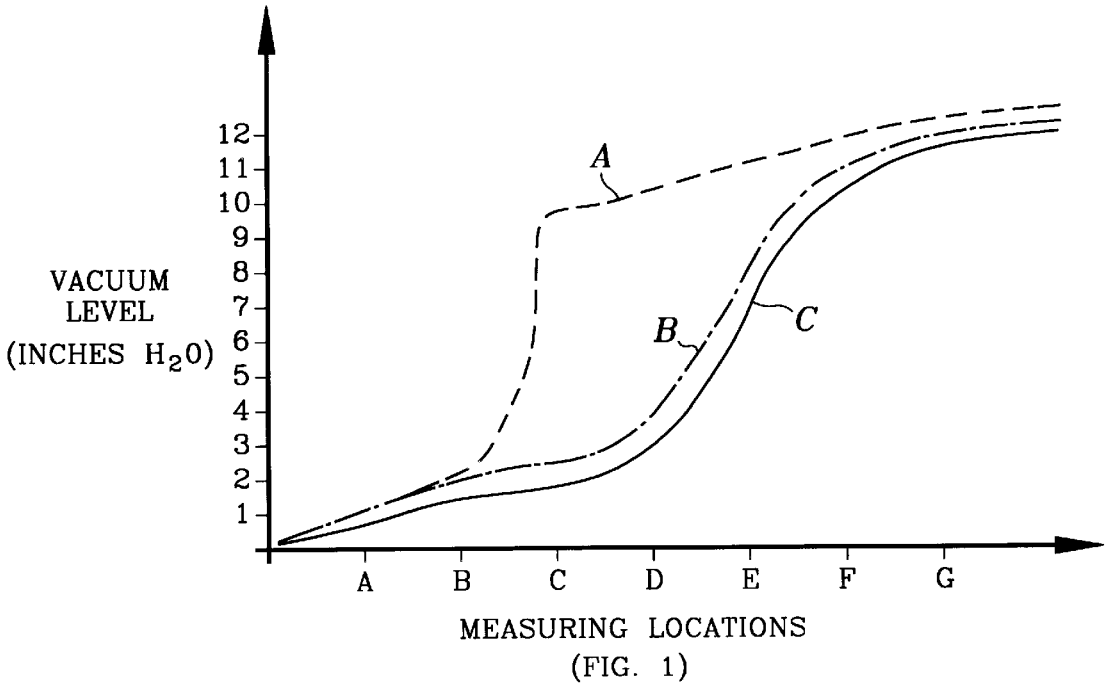
FIG. 2 is a graph of vacuum levels vs. measuring locations shown in FIG. 1 in one of the vacuum heads.

An important aspect of the present invention is the use of vacuum sensors 50 and 52 which are connected respectively to vacuum heads 16 and 18 via tubing 54 and 56. Vacuum sensors 50 and 52 may comprise, for example, a series MPL-500 pressure sensor manufactured and sold by Micro Pneumatic Logic, Inc. of Fort Lauderdale, Fla. Sensors 50 and 52 are normally open, off, diaphragm operated, pressure switches which utilize low stressed deflecting contacts. Pressure acting against the diaphragm causes a contact blade to deflect, thereby completing an electrical circuit, placing the switch in an on-state. Switches 50 and 52 sense vacuum level in heads 16 and 18 at locations close to gap 20 where there is a maximum vacuum gradient regarding overlapped/nonoverlapped apertures 24 and 30 created by documents 12 passing along document path 14. The vacuum gradient at the sensing locations, regarding overlapped/nonoverlapped apertures 24 and 30 may range from a low level of, for example, 2 inches of water to a high level, for example, of 10 inches of water. When a single document 12 covers apertures 24 or 30, vacuum rises from a low level to a high level, and triggers either switch 50 or 52. The trigger point of switches 50 and 52 may be, for example, 5 inches of water. FIG. 2 illustrates a graph of vacuum levels at locations A–G identified in FIG. 1. Curve A represents vacuum levels when a document 12 overlaps apertures 24 or 30 in head 16 or 18. Curve B represents vacuum levels in the opposite head 16 or 18 when a document 12 is present in gap 20. Curve C represents vacuum levels when no document 12 is present in gap 20.

If a single document 12 is present within gap 20, one switch 50 or 52 will be in the on-state, while the other switch

50 or 52 will be in the off-state, representing the sensing of a high level of vacuum in either head 16 or 18 and a low level of vacuum in the opposite head 16 or 18. When multiple documents 12 occur within gap 20, suction force generated by heads 16 and 18 will separate documents 12 which will cover apertures 24 and 30 on both heads 16 and 18, causing a rise of vacuum in both heads 16 and 18, i.e., in both switches 50 and 52 from a low level to a high level, thereby triggering both switches 50 and 52 to the on-state. Both switches 50 and 52 are in the on-state only when multiple documents 12 are present within gap 20 along document path 14.

Heads 16 and 18 further include relief apertures 60 and 62, respectively. Apertures 60 and 62 function to prevent vibration of thin documents, reduce noise in the vacuum signal detected by switches 50 and 52 to thereby avoid false document 12 detection, and prevent vacuum source 44 from overheating.

Figure 3:
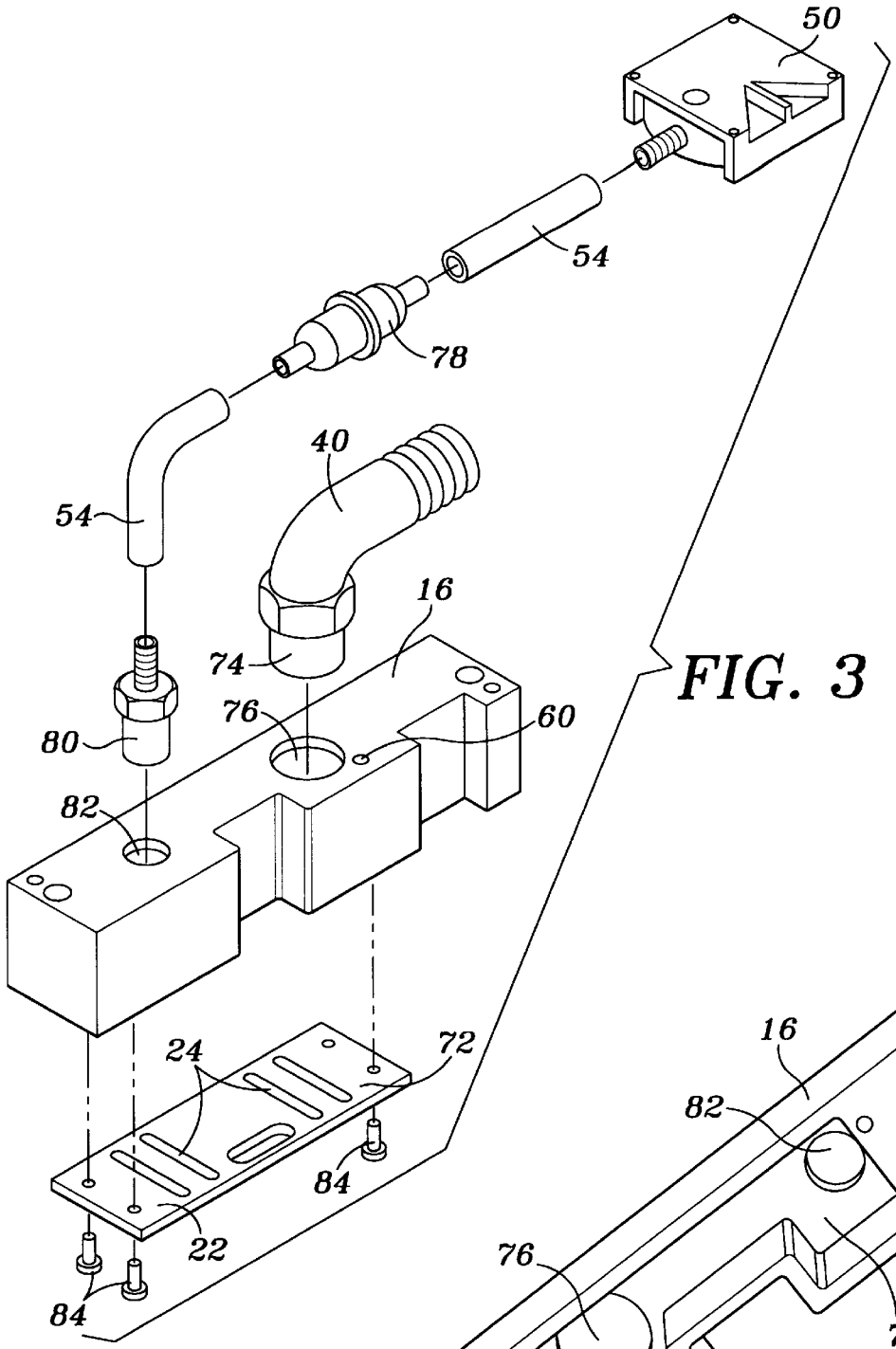
FIG. 3 is an exploded perspective view of the present vacuum head.
Figure 4:
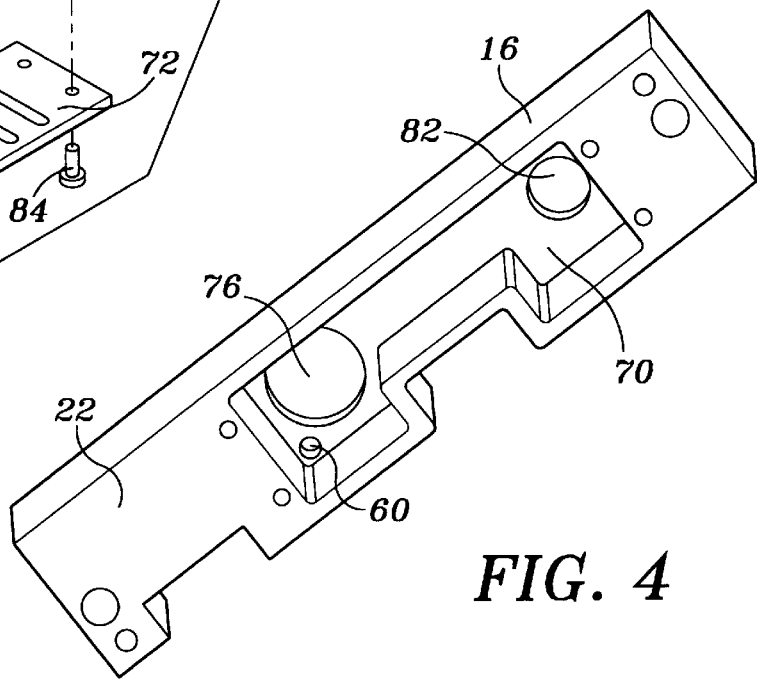
FIG. 4 is a bottom perspective view of the present vacuum head.

Referring simultaneously to FIGS. 1, 3 and 4, wherein vacuum head 16 is illustrated, it being understood that vacuum head 18 is similarly configured, head 16 includes a chamber 70 which is covered by a plate 72 containing apertures 24. Tubing 40 is interconnected to head 16 through a fitting 74 which engages an aperture 76. Switch 50 is interconnected to head 16 through a filter 78 via tubing 54 through a fitting 80 to an aperture 82. Fasteners 84 connect plate 72 to face 22 of head 16.

Whereas the present invention has been described with respect to specific embodiments thereof, it will be understood that various changes and modifications will be suggested to one skilled in the art and it is intended to encompass such changes and modifications as fall within the scope of the appended claims.

What is claimed:

1. A multi-item detector for use with a document feeder for feeding documents along a document path, the document path having an inlet and an outlet, the detector comprising:

first and second vacuum heads having juxtaposed faces and being spaced apart on opposite sides along the document path, each head being adapted to be connected to a vacuum source;

said faces including a plurality of apertures through which a vacuum is applied for drawing documents into contact with either said first or said second vacuum head;

a first vacuum sensor coupled to said first vacuum head, and being disposed adjacent the document path inlet for sensing vacuum level at the document path inlet;

a second vacuum sensor coupled to said second vacuum head, and being disposed adjacent the document path inlet for sensing vacuum level at the document path inlet; and each of said vacuum sensors having an on-state and an off-state for sensing an increase in vacuum level when a document contacts one of said vacuum heads to place said sensors in the on-state, such that when multiple documents are present in the document path, both sensors are in the on-state.

2. The detector of claim 1 wherein each of said heads include a vacuum relief port disposed opposite said face.

3. A multi-item detector for use with a document feeder for feeding documents along a document path, the detector comprising:

first and second vacuum heads having juxtaposed faces and being spaced apart on opposite sides along the document path, each head being adapted to be connected to a vacuum source, and each head including a vacuum relief port disposed opposite said face;

said faces including a plurality of apertures through which a vacuum is applied for drawing documents into contact with either said first or said second vacuum head;

a first vacuum sensor coupled to said first vacuum head;

a second vacuum sensor coupled to said second vacuum head; and each of said vacuum sensors having an on-state and an off-state for sensing an increase in vacuum level when a document contacts one of said vacuum heads to place said sensors in the on-state, such that when multiple documents are present in the document path, both sensors are in the on-state.

* * * * *